US005595026A

United States Patent [19]

Licking et al.

[11] Patent Number: 5,595,026

[45] Date of Patent: Jan. 21, 1997

[54] WINDOW ASSEMBLY WITH AN INTERNALLY PROPELLED WINDOW UNIT

[76] Inventors: Michael A. Licking, 1129 Blvd., Sturgis, S. Dak. 57785; Gerald E. Bergum, R.R. 1 Box 133, Whitewood, S. Dak. 57793

[21] Appl. No.: 303,408

[22] Filed: Sep. 9, 1994

[51] Int. Cl.[6] ..... E05F 11/00

[52] U.S. Cl. ..... 49/360; 49/280

[58] Field of Search ..... 49/139, 141, 360, 49/280, 340

[56] References Cited

U.S. PATENT DOCUMENTS

| | | | |
|---|---|---|---|
| 445,589 | 5/1984 | Longenecker | 182/76 |
| 720,399 | 2/1903 | Brewer | 49/280 X |
| 762,692 | 6/1904 | Davis | 49/280 |
| 1,002,030 | 8/1911 | Brown | 49/280 X |
| 1,859,364 | 5/1932 | Haskell | 49/340 |
| 1,879,427 | 9/1932 | Nicholas et al. | 49/141 |
| 1,919,671 | 7/1933 | Shetzline | 49/360 |
| 2,132,325 | 10/1938 | Soldatti | 49/360 |
| 2,361,040 | 10/1944 | Larsen | 49/340 |
| 2,701,631 | 2/1955 | Stouder et al. | 49/141 |
| 3,755,967 | 9/1973 | Nourse | 49/360 |
| 3,802,123 | 4/1974 | Frey et al. | 49/141 |
| 4,237,654 | 12/1980 | Landem et al. | 49/141 |
| 4,249,345 | 2/1981 | Littleton | 49/141 X |
| 4,282,685 | 8/1981 | Williams et al. | 49/141 |
| 4,879,842 | 11/1989 | Bailey | 49/141 |
| 5,029,533 | 7/1991 | Hengelmolen | 110/181 |

*Primary Examiner*—Kenneth J. Dorner
*Assistant Examiner*—Jerry Redman
*Attorney, Agent, or Firm*—Kinney & Lange

[57] ABSTRACT

A window assembly having an internal propelling system is provided. A movable window unit within a frame of the window assembly is provided. Also provided is an internal propelling system comprising at least one piston and cylinder assembly mounted at least partially within the frame of the window assembly. The internal propelling system propels the movable window unit to a relatively open position upon activation of the system.

5 Claims, 9 Drawing Sheets

24
36
41
45
44
38
45
44
42
42
26
40
40
20
52
52
37
28
30
32
2
2
29
32
34
31
34
43
22
23

36
24
41
45
44
38
45
44
42
40
40
20
42
37
52
26
52
28
56
54
54
55
55
50
50
30
48
32
32
29
48
68
68
92
34
31
34
43
60
62
22
58
58
23
65
64
46

41
44
44
56
30
42
42
26
54
54
29
32
32
20
52
52
55
34
31
34
54
67
66
28
68
68
48
48
62
43
65
22
23
64
58
46

80
41
42
42
26
85
84
98
88
81
82
8
8
97
94
86
89
90
92
83
43
60
76
22
72
62
76
58
65
64
23
58

WINDOW ASSEMBLY WITH AN INTERNALLY PROPELLED WINDOW UNIT

BACKGROUND OF THE INVENTION

The present invention relates to emergency window or door opening systems. In particular, the present invention is a window assembly having an internally propelled window unit. The window unit may be activated in situations when, for instance, the user is incapable of, or prevented from, opening the window manually. The window unit may be operated without electrical power.

Emergency door and window opening systems are known. The Frey U.S. Pat. No. 3,802,123, discloses a system for opening a sliding door automatically in the absence of electricity. The system includes a compressed air canister, an air line, an assembly including a cylinder, a piston and a rod, and a doorstop. A solenoid triggering device keeps the compressed air canister closed while electricity is available. If the electricity supply fails, the solenoid allows compressed air to escape from the canister. The air then flows through the air lines and into the cylinder where it propels the piston and rod horizontally, causing the rod to engage the doorstop and force the door open. The Frey system is designed independently from the door assembly and is intended for independent installation, often after the installation of the door. This design precludes the possibility of a mass produced, integrated unit that is easy to install. The Frey system also does not operate a locking device for the door.

The Williams et al. U.S. Pat. No. 4,282,685, discloses a "trap door" construction in which the bottom frame of the window collapses when a latch is pulled, causing the window to fall into a cavity in the wall. The window is designed to remain in a fixed, closed position under normal conditions; it can only be opened by use of the latch. Hence, the Williams design does not allow for normal use of the window. Further, the design requires significant modification to the adjacent wall.

A continuing need exists for a window assembly that accommodates an emergency opening system as does the present invention. The prior art does not cover an integrated assembly which is suitable for mass production and easy to install, and which does not require electrical power and may be operated manually as a normal window.

SUMMARY OF THE INVENTION

The present invention provides a window or door assembly that contains an internally propelled window or door unit. A movable window unit housed within a frame can be caused to open upon occurrence of an initiating event, without the use of manual force, by an internal propelling system fitted within the frame.

In one alternative embodiment, the movable window unit and the frame fit together such that each vertical side contains a channel. The movable window unit slides within the frame along the perimeter of the channels. The internal propelling system includes one or two piston and cylinder assemblies, each assembly positioned within a channel. A piston rod of the piston and cylinder assembly connects to a cross bar positioned across the movable window unit. The piston and cylinder assemblies are connected by compressed air transport lines to a compressed air canister which is positioned in a location accessible to the intended users. When a user desires to activate the internal propelling system, he or she presses a button connected to the air canister which causes compressed air to be released from the canister into the lines. The compressed air flows through lines and into the cylinders, thereby forcing the pistons, the attached rods, and the cross bar to propel the movable window unit in an opening direction. A similar arrangement for a door assembly is also possible.

The window or door assembly may also contain a locking device that operates together with the internal propelling system. In one alternative embodiment, the locking device is positioned within the frame of the assembly such that a locking arm of the device is able to engage a hook in an exterior hinged storm window. A separate compressed air transport line connects the compressed air canister to the locking device. When the internal propelling system is activated, compressed air enters the locking device, forcing a piston to move in such a way that the locking arm releases from the hook on the external hinged window, allowing the hinged window to swing freely about the hinge. At the same time, the internally propelled unit moves in an opening direction as described previously. An individual may then exit through the resulting opening in the frame, pushing the externally hinged window away. Compressed air remains in the cylinders, holding the internally propelled unit in an opened position, and the locking device in an unlocked position, until the air transport lines are depressurized.

DETAILED DESCRIPTION OF THE PREFERRED EMBODIMENTS

Figure 1:
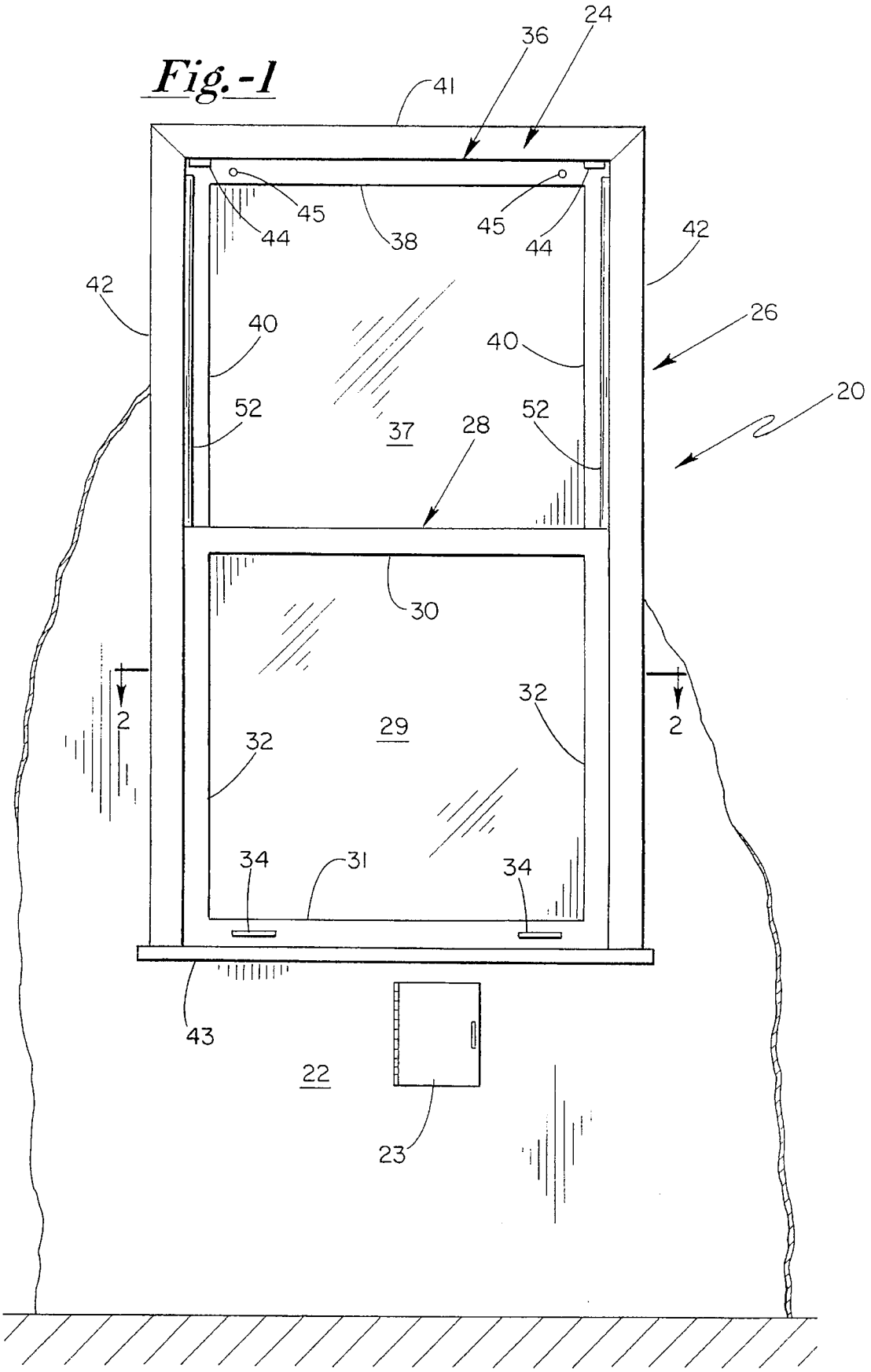
FIG. 1 is an interior view of a window assembly of the present invention positioned within a wall.

FIG. 1 depicts visible portions of the inside of a window assembly 20 installed in an exterior wall as an embodiment of the present invention. The present invention will be described in relation to a window assembly having two separate window units, an upper unit and a lower unit, where the upper unit is fixed within the frame and the lower unit slidably moves within the frame. This type of window assembly is sometimes referred to as a double hung window. However, the present invention also applies to casement windows, sliding doors, and similar assemblies.

The window assembly 20 has a movable window unit 28 and a second window unit 36 both mounted in a frame 26 with the frame 26 being mounted within a wall 22 partially shown in FIG. 1. A door 23 is also mounted within the wall 22 for reasons to be described below. The movable window unit 28 has a pane 29 held above by an upper sash 30 and below by a lower sash 31 and having side sashes 32 connected therebetween to also hold pane 29. Handles 34 mounted on lower sash 31 on the room side of the window aid an individual inside the room in manually moving the window unit 28. The second window unit 36 has a pane 37 held by an upper sash 38 and a lower sash (hidden) and having side sashes 40 connected therebetween that also hold pane 37. In the preferred embodiment, the second window unit 36 is not movable within frame 26. Frame 26 has side frame members 42 connected between a top frame member 41 and a bottom frame member 43 to capture window unit 36 and aid in holding window unit 28 as will be described below. Rubber stops 44 are attached to the top frame member 41 to abut the upper sash 30 of the window unit 28 when the window unit 28 is fully opened.

In an alternative embodiment, the second window unit 36 also moves within the frame 26. In this embodiment, pegs 45, as seen in FIG. 1, extend inwardly from upper sash 38 into the path of the moveable window unit 28. If the upper window unit 36 is in a position other than the one shown in FIG. 1, the pegs 45 will be engaged by the upper sash 30 when the window unit 28 is raised to a fully open position. As a result, the upper window unit 36 will be moved to a fully raised position as in FIG. 1.

Figure 2:
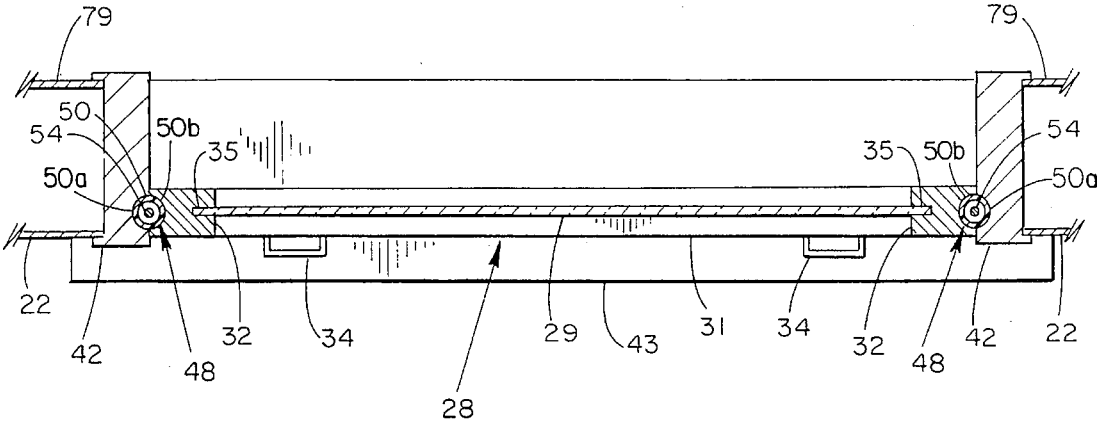
FIG. 2 is a sectional view of the window assembly taken along line 2—2 of FIG. 1.

FIG. 2 is a sectional view taken along line 2—2 of FIG. 1. As illustrated in FIG. 2, each side frame member 42 extends from the inner wall 22 to an exterior wall 79. Each side frame member 42 is adjacent a corresponding side sash 32 of the window unit 28. Grooves 35 hold the window pane 29 between the side sashes 32. A half-channel 50*a* extends the entire vertical length of each side frame member 42 and a half-channel 50*b* extends the entire vertical length of each side sash 32. Two channels 50 are formed by the alignment of corresponding half-channels 50*a* and 50*b* of each frame-sash pair formed of an adjacent side frame member 42 and side sash 32. A pair of piston and cylinder assemblies 48 are provided, each housed within a corresponding one of the channels 50 as will be further described below. One of a pair of rods 54 connects to each piston (not shown) in the piston and cylinder assemblies 48 and extends out from that piston within the corresponding one of the channels 50.

Figure 3:
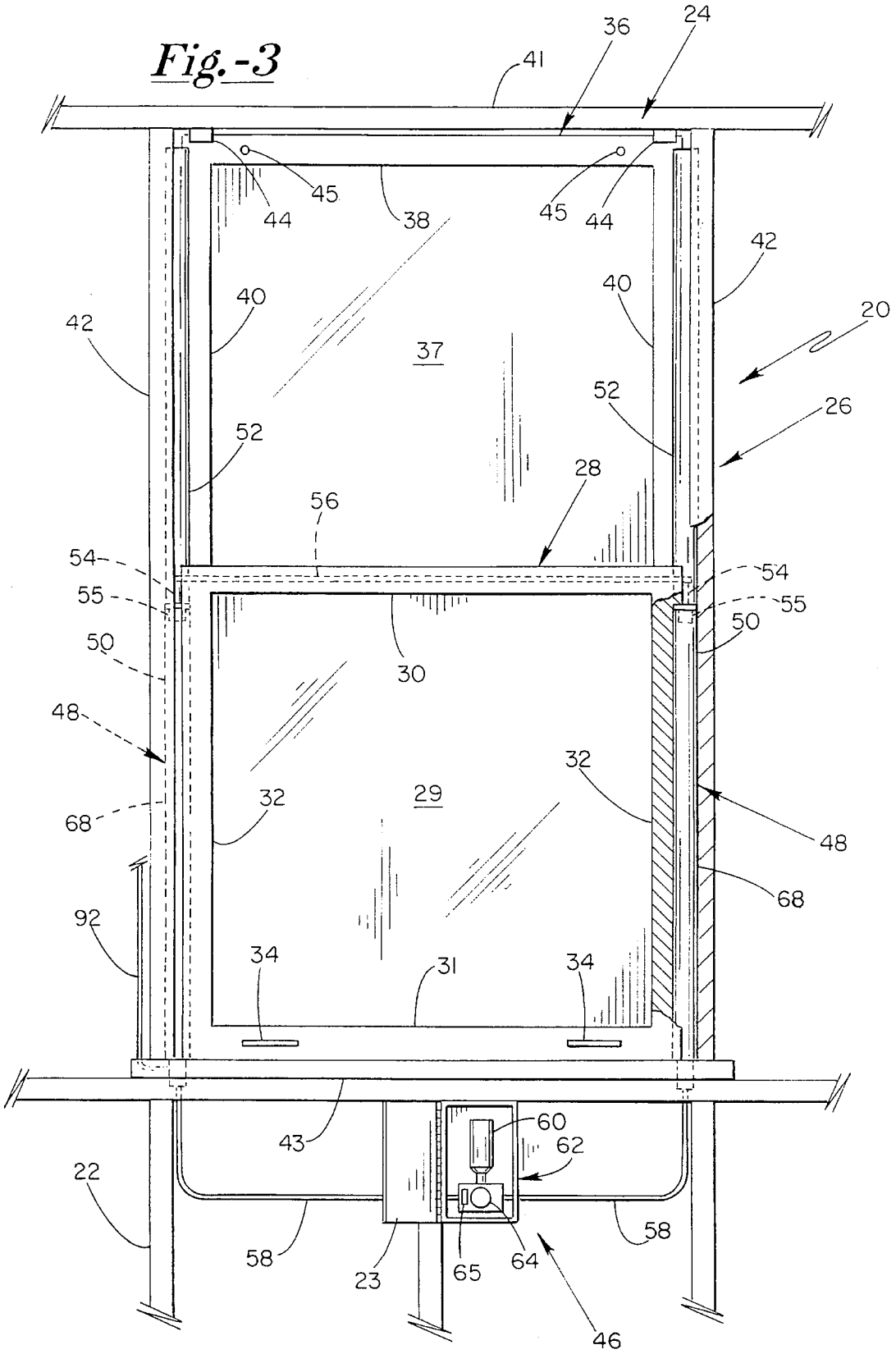
FIG. 3 is a plan view of the window assembly of FIG. 1 with a portion cut away to reveal an internal propelling system of the present invention.

FIG. 3 illustrates an internal propelling system 46. In the preferred embodiment, the internal propelling system 46 includes the two piston and cylinder assemblies 48 positioned within the channels 50 as described above. However, it should be noted that one piston and cylinder assembly may be sufficient. As seen primarily in phantom, a cross bar 56 is provided affixed to the upper sash 30 of the window unit 28. The cross bar 56 extends past each of the side sashes 32 and into the adjacent ones of channels 50 for engagement with each of the rods 54 therein. It should also be noted that the cross bar 56 may be replaced by two pegs, or other such projecting members, each extending into a corresponding one of the channels 50. Each side frame member 42 has a hollow pipe 52 equal in outer diameter to the corresponding piston and cylinder assembly 48 contained within the side frame member 42. Each hollow pipe 52 extends along the corresponding side frame member 42 from the top of the corresponding piston and cylinder assembly 48 to the top frame member 41. Each of a pair of rod guides 55, which are in the form of bushings in the interior of piston and cylinder assemblies 48, shown in phantom, stabilizes a corresponding rod 54 as it moves therethrough within its corresponding pipe 52. Each of pipes 52 has a slot (hidden) which accommodates a corresponding end of the cross bar 56 as the movable window unit 28 moves from a closed position to an open position.

A compressed air canister 60 is housed within a metal box 62 which is situated adjacent the window assembly 20 and partially within the wall 22 behind the door 23 which provides access thereto. A button 64 located within the box 62 is linked to a firing pin (not shown) in the compressed air canister 60 and acts as a trigger, when pressed, for releasing air from the canister 60. The firing pin (not shown) pierces the exterior of the canister 60 to release compressed air. The use of a firing pin to pierce the exterior prevents the possibility of slow leakage through a valve. A pair of air transport lines 58 are connected to the compressed air canister 60 and to corresponding ones of the piston and cylinder assemblies 48. Each of air transport lines 58 transports compressed air to its corresponding piston and cylinder assembly 48 when the system is activated by pressing button 64. As an alternative, other event detection triggers such as a smoke detector, a voice recognition unit, a thermometer, as infrared remote control system, or an electric switch may be used in placed of the button 64. A release valve 65 is positioned in box 62 connected to lines 58 and is used to release compressed air from these lines (and the piston and cylinder assemblies 48) after the system has been activated to permit closing window unit 28.

To facilitate manufacturing, transportation, and installation, the movable window unit 28 and the frame 26 of window assembly 20 contain between them in channels 50 formed by them the piston and cylinder assemblies 48, the pipes 52, the rods 54, and the rod guides 55. The cross bar 56 is further contained in unit 28, except for the ends thereof in pipes 52, to thereby form a single unit. In addition, the box 62, housing button 64, canister 60, and valve 65 may be positioned within the bottom frame member 43, so that air lines 58 may be connected both to the canister 60 and the piston and cylinder assemblies 48, thereby making the window assembly 20 fully self-contained.

Figure 4:
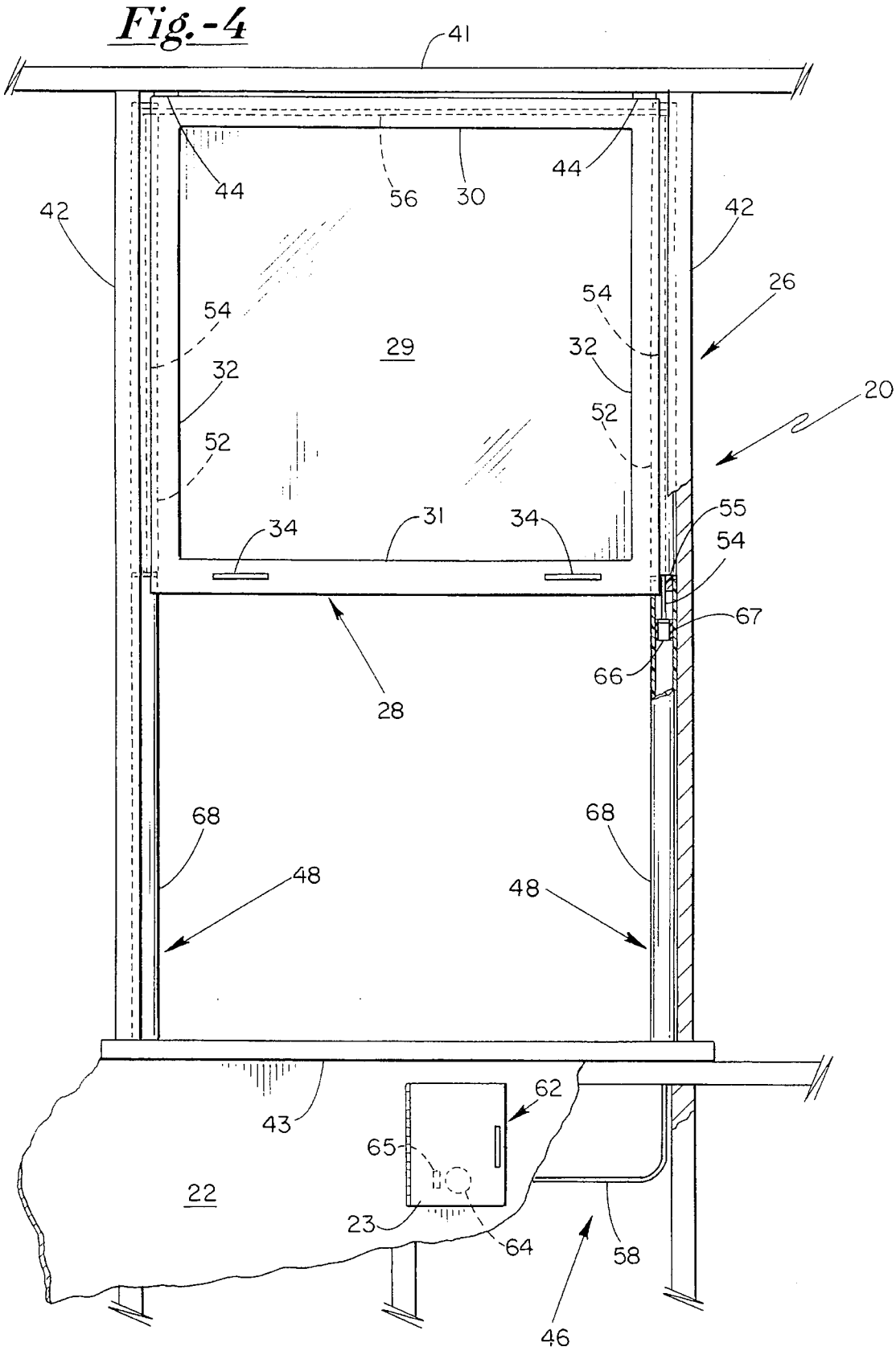
FIG. 4 is a plan view of the window assembly of FIG. 1 in an open position.

FIG. 4 illustrates the movable window unit 28 in an open position, and shows one of the piston and cylinder assemblies 48 partially cut away. The upper sash 30 is illustrated abutting rubber stops 44 with rods 54 extended sufficiently within the pipes 52 to achieve this abutment. The cut-away portion of the piston and cylinder assembly 48 illustrates a piston 66 engaging the rod 54. A cylindrical shell, here termed a cylinder 68, that is closed at its lower end, houses the piston 66. The piston 66 is moved in the cylinder 68 by the presence of compressed air that enters the cylinder 68. The piston 66 incorporates a rubber cup 67 that sealably abuts the interior of the cylinder 68 to provide an air tight seal between the piston 66 and the cylinder 68 while still allowing the piston 66 to move within the cylinder 68.

Figure 5:
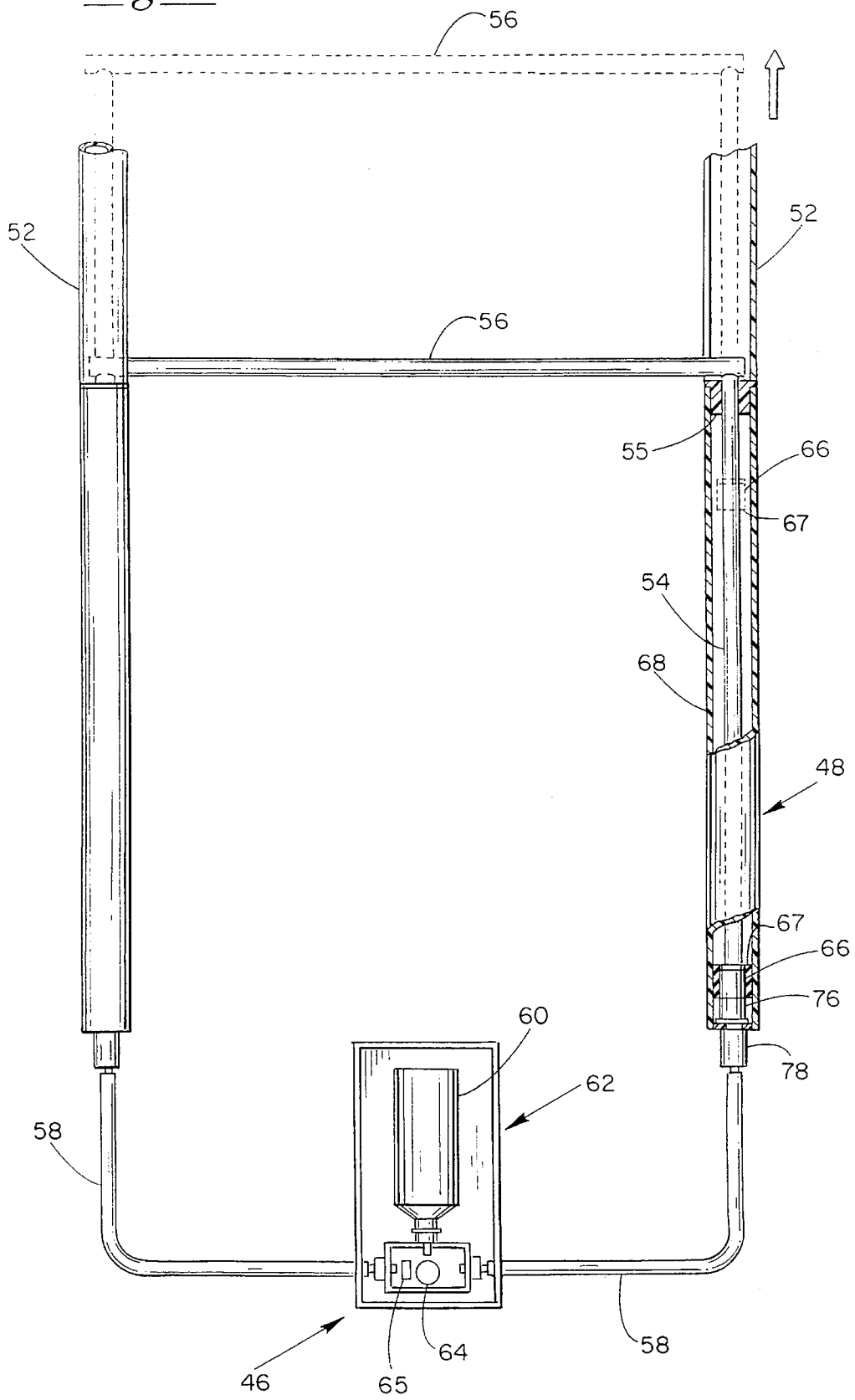
FIG. 5 is an enlarged view of the internal propelling system of the present invention with a portion cut away.

To activate the internal propelling system 46, a user opens door 23 and presses the button 64 linked by a firing pin to the compressed air canister 60, thereby releasing compressed air into the air lines 58 and subsequently into the piston and cylinder assemblies 48. Compressed air within the piston and cylinder assemblies 48 causes each of the pistons 66 to rise into abutment with its corresponding one of the rods 54, lifting the cross bar 56 and the movable window unit 28 in an upward direction. While moving in the upward direction, the side sashes 32 are guided along the outer sides of the cylinders 68 and then along the outer sides of the pipes 52. When the upper sash 30 hits the rubber stops 44, the movable window unit 28 ceases to move. The movable window unit 28 is held in an open position by the continued presence of compressed air in the piston and cylinder assemblies 48. By opening the release valve 65, compressed air exits the system thus removing the upward force on cross bar 56 thereby allowing the movable window unit 28 to be returned to a closed position. FIG. 5 is an enlarged view of the internal propelling system 46 without the remainder of the window assembly, and with a portion of one of the piston and cylinder assemblies 48 cut away. In the preferred embodiment, the cylinders 68 of the piston and cylinder assemblies 48 and the pipes 52 are typically made of polyvinylchloride (PVC) polymer material. Commercially available cylinders 68 and pipes 52 have an inside diameter of about 0.75 inches and an outside diameter of about 1.0625 inches. In another preferred embodiment, the cylinders 68 and the pipes 52 have an inside diameter of 0.5 inches, thereby eliminating the need for the rod guides 55. It should be noted that any other suitable cylinder material may be used such as aluminum, copper, or galvanized sheet steel. The cylinders 68 must be designed to accommodate a minimum air pressure of fifty pounds per square inch (p.s.i.) without bursting, and pistons 66 must be able to retain such compressed air behind them while still being able to move along the interior of the cylinders 68 at such a pressure. The air transport lines 58, typically made of braided nylon, must also be able to contain air under pressures up to at least fifty p.s.i. An entry fitting 76 with a pipe reducer 78 connects each air line 58 to the corresponding cylinder 68. This construction provides an airtight connection that aids in maintaining air pressure within the cylinders after the system has been activated.

As illustrated in the cut away portion of FIG. 5, each rod 54 extends out of the corresponding cylinder 68 to connect with the cross bar 56. The rods 54 and the cross bar 56 are permanently connected together to provide a stable framework for the moving window unit 28. It is possible that the rods 54 could be permanently attached to the pistons 66 and not to the cross bar 56. As shown in phantom, the rods 54 extend upward from the cylinders 68 along with the cross bar 56 when the system is activated. During manual operation, the rods 54 move within the pipes 52 so that cross bar 56 and window unit 28 can be moved up and down. However, since the piston 66 is not permanently attached to the rod 54, it does not move during manual operation of the window unit 28. When compressed air enters the cylinders 68, the pistons 66 are forced up against the rods 54 by the force of the compressed air to move the cross bar 56 and the window unit 28. Because the piston 66 is not permanently attached to the rod 54, there is minimal piston wear due to manual operation of the window unit 28.

Figure 6:
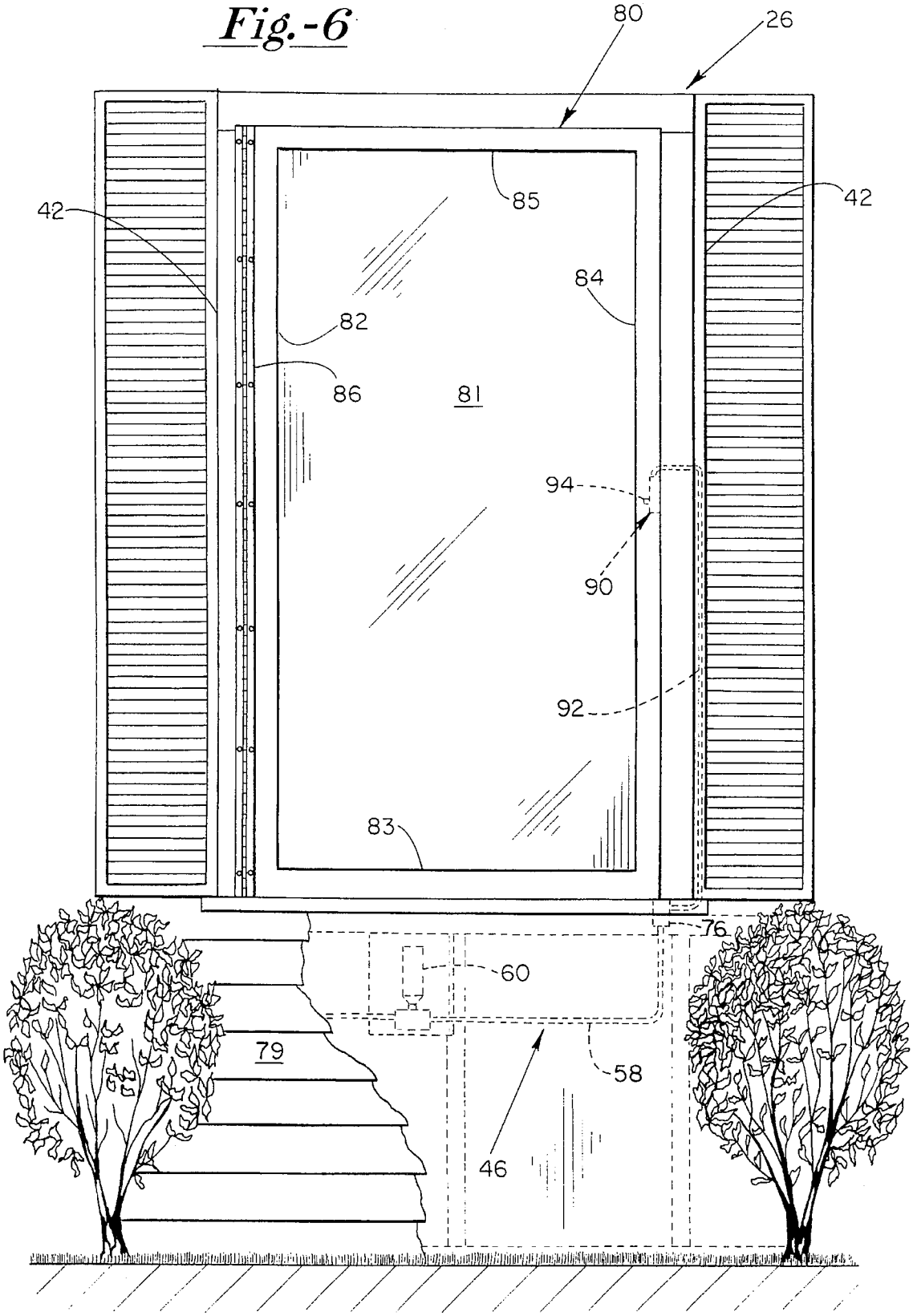
FIG. 6 is an exterior view of an exterior window and a locking device of the present invention.

FIG. 6 is an exterior view of an exterior window 80 affixed to the frame 26 within the exterior wall 79. In the preferred embodiment, the exterior window 80 is a storm window; however, a screen window could also be used. The exterior window 80 has a pane 81 held in place between a hinged edge 82 and a latchable edge 84, each extending from a bottom edge 83 to a top edge 85, which also hold the pane 81 therebetween. A hinge 86 is provided to pivotally mount the exterior window 80 at edge 82 thereof to the side frame member 42 of the frame 26. A locking device 90 (shown in phantom positioned adjacent the side frame member 42 of the frame 26) engages the hook 89 within the cavity 88. An extension air line 92 connects the locking device 90 to the compressed air canister 60 through one of the entry fittings 76 and the corresponding air line 58. The locking device 90 unlocks the exterior window 80 upon activation of the internal propelling system 46 in a manner to be described below.

Figure 7:
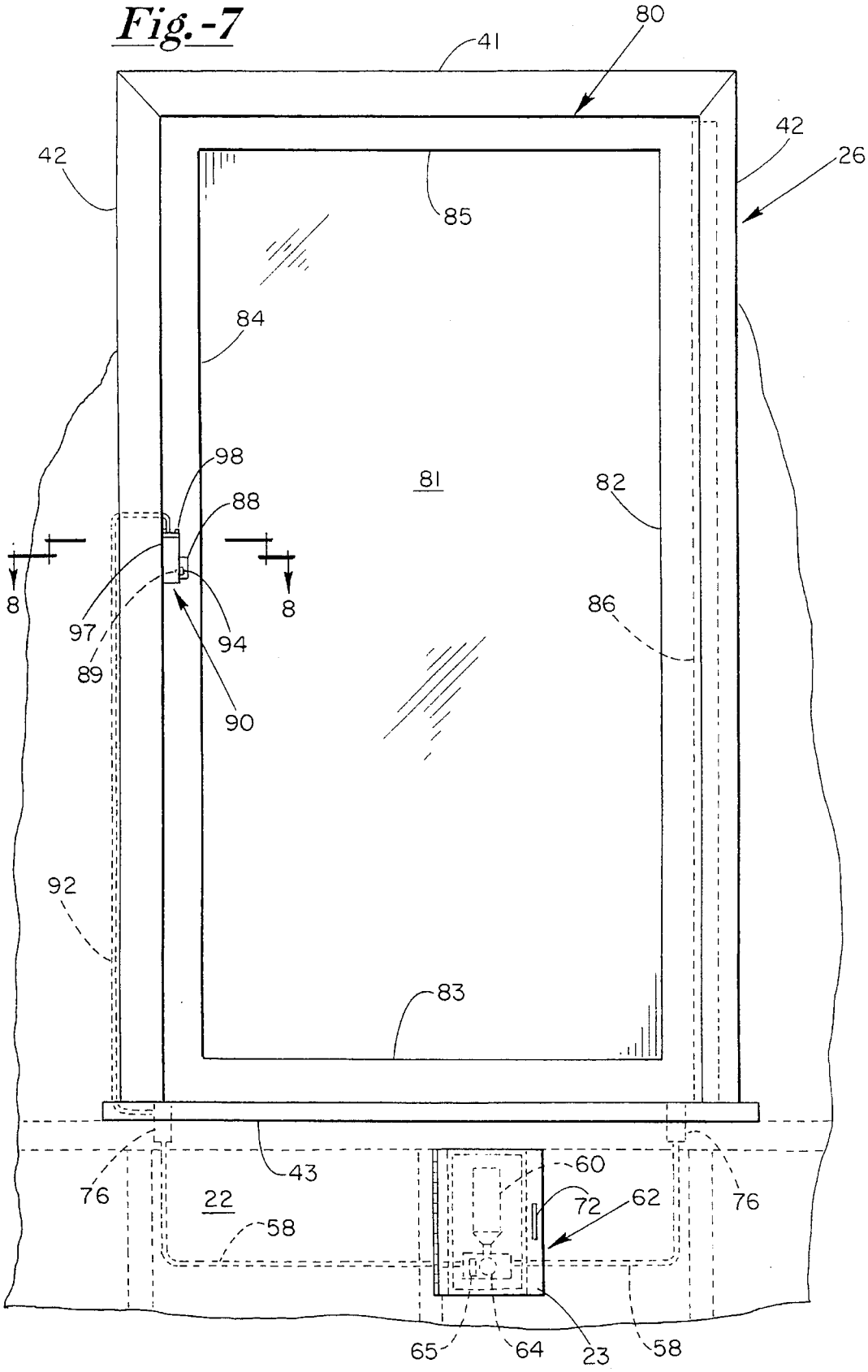
FIG. 7 is an interior plan view of the exterior window and the locking device in a locked position according to the present invention.

FIG. 7 is an interior plan view of the storm window 80 and the locking device 90 positioned within the frame 26. It should be noted that for this figure, the movable window unit 28, the second window unit 36, the piston and cylinder assemblies 48, and the pipes 52 have been omitted from the frame 26. A locking arm 94 extends out from a case 97 of the locking device 90 to engage a hook 89 within a cavity 88 of the latchable edge 84. Lid screws 98 secure a lid 100 to the case 97, thereby ensuring an airtight connection for operation of the locking device 90 as will be described below. In the preferred embodiment, all the components of the locking device 90 are made of sheet metal.

Figure 8:
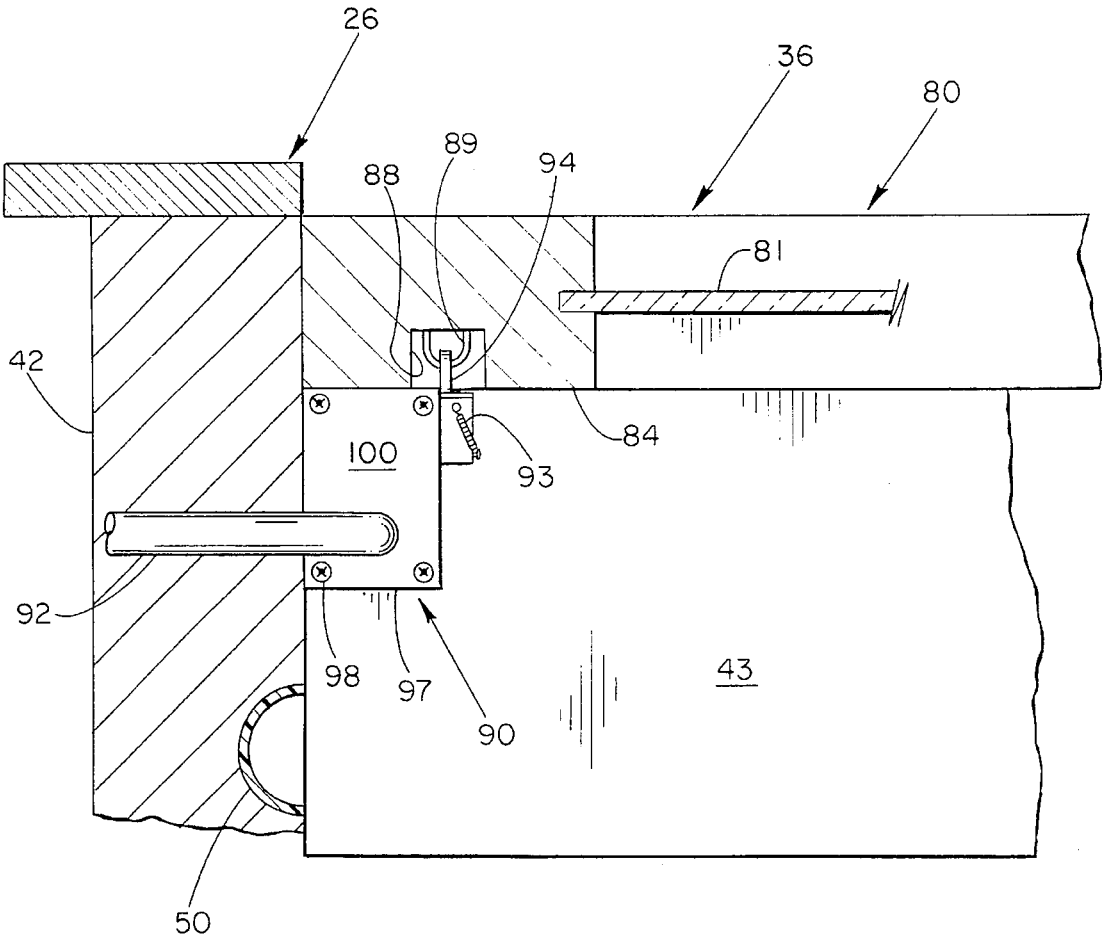
FIG. 8 is a sectional view of the locking device and the exterior window taken along line 8—8 of FIG. 7.

FIG. 8 is a sectional view taken along line 8—8 of FIG. 7, showing the positioning of the locking device 90 within the frame 26 and with respect to the exterior window 80. The locking arm 94 rotates about a pivot (hidden) to engage or disengage the hook 89 within the cavity 88 of the exterior window 80. When the locking arm 94 engages the hook 89, the edge 84 of the exterior window 80 is prevented from moving away from the frame 26.

As an alternative, the locking device 90 may have a biasing mechanism such as a spring 93 affixed to the locking arm 94 and attached to the case 97. To unlock the external window manually, a user may rotate the locking arm 94 to disengage it from the hook 89. When the user releases the locking arm 94, the spring forces the locking arm 94 to rotate back into the locked position.

Figure 9:
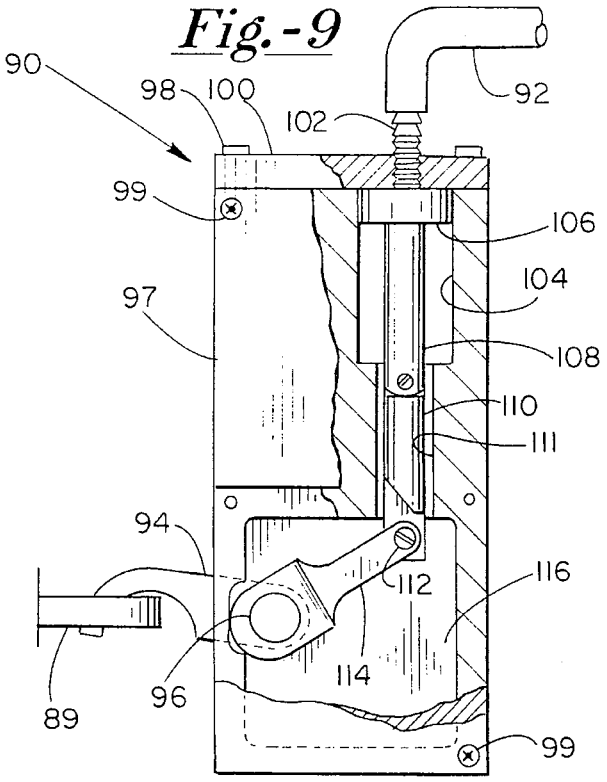
FIG. 9 is a partial cut-away of the locking device of FIG. 7 in a locked position.

FIG. 9 is a partial cut-away of the locking device 90 in a locked position. Case screws 99 affix the case 97 to the side frame member 42 (not shown). The locking device 90 has a cylindrical cavity 104 therein containing a piston 106 shown sealingly abutting the cavity 104 and connected to a rod 108 extending downward therefrom. The piston 106 has a rubber cup (not shown) which facilitates its movement within and sealing engagement to the cavity 104. The locking device 90 also includes an extension shaft 110 within a reduced diameter cylindrical cavity 111, having a pin 112 connecting shaft 110 to a pivoting arm 114 in a pivoting chamber 116. In the locked position, the piston 106 is positioned at the top of the cavity 104. The rod 108 is held by the extension arm 110 within the cavity 111 such that the connected pivoting arm 114 at its pin 112 end is in an upward position within the pivoting chamber 116. The pivoting arm 114 and locking arm 94 are securely affixed to a pivot 96 such that when the pivoting arm 114 at its pin 112 end is in an upward position within the pivoting chamber 116, the locking arm 94 is rotated to engage the hook 89. To put the locking device 90 in a locked position, a user manually rotates the locking arm 94 such that it is in a position to engage the hook 89.

Figure 10:
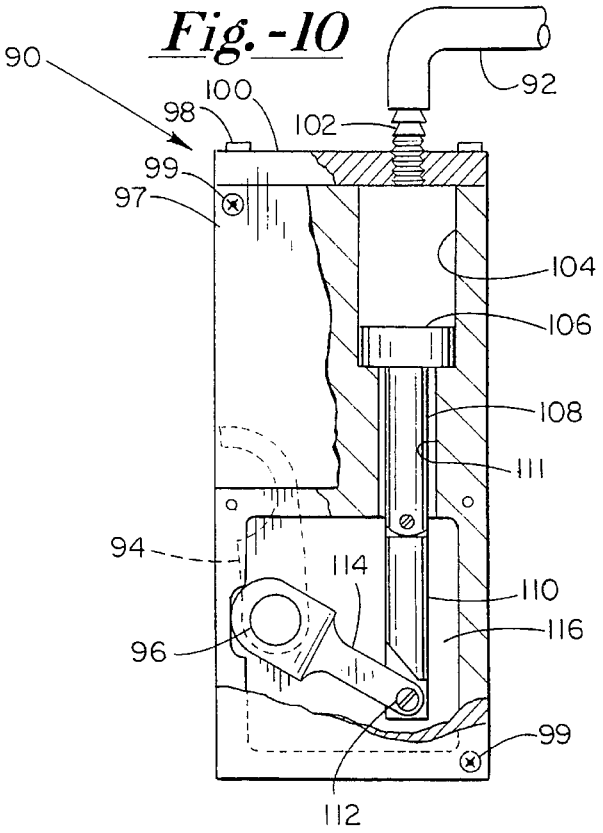
FIG. 10 is a partial cut-away view of the locking device of FIG. 7 in an unlocked position.

FIG. 10 is a partial cut-away of the locking device 90 with the locking arm 94 in an open position due to activation of the internal propelling system 46. This position can also be obtained manually by pushing the locking arm 94 away from the hook 89. After an activation of system 46, when compressed air from the air line 92 is entering the cylinder 104, the piston 106 is forced to the bottom of the cylinder 104. This movement forces the rod 108 into the cavity 111 and the extension shaft 110 into the pivoting chamber 116. As a result, the pivoting arm 114 rotates about the pin 112 as it moves to a downward position at its pin 112 end within the pivoting chamber 116, thereby rotating pivot 96. The downward rotation of the pivoting arm 114 in turn causes the locking arm 94 to rotate upward with the rotating pivot 96 into an unlocked position.

The internal propelling system 46 and the locking device 90 operate together. Upon activation, compressed air flows from the compressed air canister 60 into the air transport lines 58 and subsequently into the extension air line 92. Compressed air entering into the piston and cylinder assemblies 48 opens the moveable window unit 28 as described previously (see FIG. 4). Compressed air entering into the cavity 104 of the locking device 90 forces the piston 106 downward. As a result the extension shaft 110 causes the pivoting arm 114 to rotate to a downward position at its pin end 112 within pivoting chamber 116. In turn, the locking arm 94 releases from the hook 89 of the exterior window 80, moving into an unlocked position. The user may then exit through the opening in the frame 26 by pushing the exterior window 80 away, causing it to rotate about the hinge 86 (see FIG. 6).

The window assembly of the present invention includes a self-contained internal propelling system and a locking device which may be activated simply by pushing a conveniently located button. The present invention would also work on casement type windows and sliding doors with slight modifications. For example, with sliding doors, the piston and cylinder assembly 48 is positioned within top and bottom door frames and pushes the door to an open position upon activation. The window assembly substantially conceals the opening system and the unlocking device from normal view and allows users to operate the window manually. As a self-contained system, the assembly is amenable to mass production and is easy to assemble and install, conforming to standard building window dimensions. Finally, the system operates even when no electricity is available, thereby allowing for ready exit in emergency situations.

Although the present invention has been described with reference to preferred embodiments, workers skilled in the art will recognize that changes may be made in form and detail without departing from the spirit and scope of the invention.

What is claimed is:

1. A window assembly containing an internal propelling system, the assembly comprising:

a frame to define a window opening;

a movable window unit mounted in the frame within the window opening; and an internal propelling system comprising at least one piston and cylinder assembly mounted at least partially within the frame for propelling the movable window unit to a relatively open position upon activation, the internal propelling system including an extension member attached to the movable window unit and at least one rod connected to the at least one piston and cylinder assembly, wherein, upon activation of the system, the rod abuts and propels the extension member, thereby moving the attached movable window unit to an open position, the extension member defined by a cross bar extending from one end to an opposite end of the movable window unit.

2. A window assembly containing an internal propelling system, the assembly comprising:

a frame to define a window opening;

a movable window unit mounted in the frame within the window opening;

an internal propelling system comprising at least one piston and cylinder assembly mounted at least partially within the frame for propelling the movable window unit to a relatively open position upon activation, the piston and cylinder assembly powered by a compressed air canister; and a safety box having a door, the safety box housing the compressed air canister.

3. A window assembly containing an internal propelling system, the assembly comprising:

a frame to define a window opening;

a movable window unit mounted in the frame within the window opening;

an internal propelling system comprising at least one piston and cylinder assembly mounted at least partially within the frame for propelling the movable window unit to a relatively open position upon activation a locking device operating in conjunction with the internal propelling system; and an exterior window unit, wherein the exterior window unit is pivotally connected to the frame and has a hook, and wherein the locking device is positioned within the frame such that a locking arm engages the hook when the device is in a locked position, thereby preventing the exterior window unit from pivotally moving.

4. The window assembly of claim 3 wherein the locking device further comprises a piston within a cylindrical cavity, the piston moving the locking arm from the locked position to an open position when the system is activated, thereby allowing the exterior window unit to move pivotally.

5. The window assembly of claim 4 wherein the piston is powered by a compressed air canister which connects to the locking device by an air transport line.

* * * * *

UNITED STATES PATENT AND TRADEMARK OFFICE

CERTIFICATE OF CORRECTION

PATENT NO. : 5,595,026

DATED : JANUARY 21, 1997

INVENTOR(S) : MICHAEL L. LOCKING, GERALD E. BERGUM

It is certified that error appears in the above-indentified patent and that said Letters Patent is hereby corrected as shown below:

On the Title Page [56] under "References Cited" U.S. Patent Documents, delete "445,589", insert --4,445,589--

Signed and Sealed this

Sixth Day of May, 1997

Bruce Lehman

*Attest:*

BRUCE LEHMAN

*Attesting Officer*

*Commissioner of Patents and Trademarks*